US007717037B2

(12) United States Patent
Czeranka et al.

(10) Patent No.: US 7,717,037 B2
(45) Date of Patent: May 18, 2010

(54) HUMID MEDIA TRANSFER DEVICE AND/OR PRINTING MEDIA TRANSFER DEVICE OF PRINTING MACHINES

(75) Inventors: Ruediger Czeranka, Bissendorf (DE); Thomas Rosemann, Bissendorf (DE); Achim Siebert, Melle (DE); Joerg Tellenbroeker, Spenge (DE)

(73) Assignee: WEROS Dienstleistungen GmbH, Melle (DE)

( * ) Notice: Subject to any disclaimer, the term of this patent is extended or adjusted under 35 U.S.C. 154(b) by 850 days.

(21) Appl. No.: 11/272,474

(22) Filed: Nov. 10, 2005

(65) Prior Publication Data

US 2006/0185541 A1 Aug. 24, 2006

(30) Foreign Application Priority Data

Nov. 10, 2004 (DE) ..... 10 2004 054 425

(51) Int. Cl.
*B41F 13/10* (2006.01)

(52) U.S. Cl. ..... 101/375; 101/147; 101/376

(58) Field of Classification Search ..... 101/147, 101/148, 375, 376

See application file for complete search history.

(56) References Cited

U.S. PATENT DOCUMENTS

| | | | | |
|---|---|---|---|---|
| 4,015,046 | A | 3/1977 | Pinkston et al. | |
| 6,029,571 | A * | 2/2000 | Johner et al. | 101/148 |
| 6,244,176 | B1 | 6/2001 | Sonobe | |
| 6,394,944 | B1 * | 5/2002 | Hyllberg et al. | 492/54 |
| 6,935,995 | B2 | 8/2005 | Siebert et al. | |
| 2001/0051567 | A1 | 12/2001 | Schaschke | |

FOREIGN PATENT DOCUMENTS

| | | |
|---|---|---|
| DE | 2227485 | 1/1973 |
| DE | 19600736 | 7/1996 |
| DE | 19940388 | 3/2000 |
| DE | 10129107 | 1/2003 |
| DE | 202004006800 | 6/2004 |
| EP | 0629514 | 12/1994 |
| EP | 1120283 | 8/2001 |
| EP | 1334843 | 8/2003 |
| GB | 1390833 | 4/1975 |
| GB | 2296895 | 7/1996 |

OTHER PUBLICATIONS

German Office Action dated Jun. 27, 2005 issued in related German Patent Application No. 102004054425.

European Search Report dated Mar. 2, 2006 issued in related European Patent Application No. 05024609.

* cited by examiner

*Primary Examiner*—Ren Yan

(74) *Attorney, Agent, or Firm*—Grossman Tucker Perreault & Pfleger, PLLC

(57) ABSTRACT

The invention relates to the use of a roller or a rubber blanket with a covering made of elastomeric material with an outer surface for indirect or direct transfer of a damping solution and/or a printing agent to a print carrier of a printing press. In order to enable a virtually optimum printing result, even in the presence of changing process conditions, and to display improved back-transfer properties with unchanging properties over the service life, it is proposed that a roller/rubber blanket be used which has an outer surface that constitutes an elastomeric surface coating of the covering and contains, or completely consists of, a fluoroelastomer, particularly an elastomeric fluorinated rubber. The fluorinated rubber can, in particular, be a tetrafluoroethylene-hexafluoropropylene-vinylidene fluoride copolymer.

19 Claims, 2 Drawing Sheets

HUMID MEDIA TRANSFER DEVICE AND/OR PRINTING MEDIA TRANSFER DEVICE OF PRINTING MACHINES

CROSS-REFERENCE TO RELATED APPLICATIONS

This application claims priority to DL 10 2004 054 425.5, filed Nov. 10, 2004.

FIELD

The invention relates to a roller or a rubber blanket for a printing press, with a covering made of an elastomeric material with an outer surface as a damping solution and/or printing agent transfer device for printing presses for indirect or direct transfer of a damping solution and/or printing agent to a print carrier, and use of a roller or rubber blanket of this kind, and a printing press with a roller or rubber blanket of this kind (also generally referred to as a printing blanket).

BACKGROUND

Rollers or rubber blankets of this kind for printing presses are used in offset printing, for example. In this context, the printing agent, e.g. a customary printing ink, is transferred from a reservoir, via an inking unit to a printing plate, to which the respective image is applied, generally by a photomechanical process. The printing areas of the printing plate accept the ink, such that the image to be printed can be transferred to a rubber blanket that is likewise mounted on a cylinder. The printing ink is transferred from the rubber blanket to the respective print carrier, i.e. the material to be printed, such as a paper web, a film, or some other object. At the same time, the printing plate is wetted with a damping solution, which is supplied from a reservoir by a damping unit. The damping solution covers the non-printing areas of the printing plate, such that they do not accept ink, thereby producing the print image. The damping solution is usually water, which can contain alcohols or other additives. In this context, the damping unit and the inking unit each consist of a plurality of rollers, where, in some cases, rollers with an elastomeric covering work against rollers with a metallic, ceramic or plastic surface in order to homogenize the printing agent and the damping solution in the gap between the rollers (nip), prepare them in a uniform layer and ultimately apply them to the printing plate and the rubber blanket.

The rollers with an elastomeric covering have to satisfy a host of requirements, particularly demonstrating defined mechanical properties, such as hardness, wettability with the printing agent or the damping solution, mechanical and chemical resistance, abrasion resistance, good cleanability and the like.

Moreover, particular problems are posed by defined transfer of ink and damping solution from the respective ink and damping solution reservoir, via the respective inking and damping unit to the impression cylinder. For example, it has become apparent that there is occasionally no defined transfer of damping solution and/or printing agent to the impression cylinder, and thus ultimately to the blanket cylinder, this being referred to as "overemulsification" of the ink/damping solution emulsion, i.e. too much damping solution, particularly water, is incorporated into the printing agent. The consequence of this is that, on both the impression cylinder and the rubber blanket, the areas covered with ink and the areas covered with damping solution are ultimately not accurately separated from each other, and thus that unsharp contours, streaks, or other such phenomena impairing the print quality, occur on the printed print carrier, e.g. a paper web. This "overemulsification" is partly attributed to fluctuating process conditions during the printing process, also including climate or temperature fluctuations in the print unit, for example, although these are difficult to determine and reproduce in terms of their process parameters. There is consequently a need to improve the print quality and enable a printing result that remains very constant over time.

Furthermore, known rollers variously display disadvantages in terms of their back-transfer properties, i.e. the printing agent is not optimally transferred to the next roller in the nip, but carried back on the roller. This ultimately leads to undesirable distribution of the ink and can also result in undesirable transfer of ink into the damping unit. Moreover, in the event of a color change, some of the original ink can be taken up by the roller or the rubber blanket and transferred to the subsequent print unit, this possibly leading to undesirable color deviations. These problems have likewise not yet been satisfactorily resolved. An additional aim is to further improve the back-transfer properties of the rollers.

Moreover, starting from rollers with auxiliaries, such as fluorinated polyolefins, incorporated in the elastomeric roller covering, it is desirable to further improve the long-term stability of the roller, and thus the service life of the printing press and the maintenance effort involved.

Furthermore, consideration must be given to the fact that rollers and rubber blankets with an elastomeric covering are subject to wear in printing presses, this leading to a change in the surface properties of the roller or the rubber blanket, e.g. to a roughness that changes in the course of long periods of time, and changing wetting properties in relation to the printing agent and the damping solution. As a result, it becomes necessary to replace the roller covering and fit the roller core with a new covering at certain intervals. This leads to machine downtimes and is also cost-intensive, since the covering has to be removed entirely and a complete, new roller covering built up.

The object of the invention is therefore to provide a damping solution and/or printing agent transfer device in the form of a roller or a rubber blanket for printing presses that solves the problems described above, particularly enables a virtually optimum printing result over long periods of time, even in the event of changing process conditions, such as climate or temperature fluctuations, particularly also in terms of color quality in multicolor printing, that demonstrates excellent back-transfer properties, displays a substantially longer service life with unchanged properties, particularly as regards hardness and wettability with damping solution and/or printing agent, and that permits simple restoration in the event of wear induced by operation.

SUMMARY

According to the invention, a roller or a rubber blanket is provided as a damping solution and/or printing agent transfer device that displays a continuous surface coating covering the covering of elastomeric material, said coating containing or entirely consisting of a fluoroelastomer, and where the surface coating preferably displays a layer thickness less than/equal to 100 μm and/or a roughness Ra less than/equal to 1 μm. The fluoroelastomer can be one or more elastomers selected from the group comprising elastomeric fluorinated rubber, polyfluoroalkoxyphosphazene and polyfluorosilicone. In particular, when used below, the term fluoroelastomer is in each case always to be understood as also explicitly meaning an elastomeric fluorinated rubber, this constituting a particularly preferred embodiment of a fluoroelastomer.

In contrast to Teflon-coated rollers, for example, the fluoroelastomer according to the invention provides a surface coating that consists of an elastomeric material, like the covering bearing the coating itself. This constitutes the special adaptation of the roller coating to the covering made of elastomeric material, for which purpose Teflon coatings, such as PTFE, Teflon FEP® (tetrafluoroethylene hexafluoropropylene copolymer) or other coatings made of non-elastomeric or plastically deformable polymers, such as polyvinylidene fluoride and the like, would be totally unsuitable, such that the roller surface has a high dynamic load-bearing capacity, this being of major importance both for processing of the printing agent in the nip between two rollers working against each other and also in the case of rubber blankets. The comparatively thin surface coating thus has virtually no impact on the elastic and/or dynamic properties of the covering.

It has furthermore been established that use of fluoroelastomer coatings of this kind in accordance with the invention, particularly of a fluorinated rubber, is capable of achieving highly defined and constantly consistent transport of the printing agent or the damping solution, such that overemulsification of the printing agent with damping solution, which impairs the printing quality, can be reliably avoided, even under a wide range of different process conditions. This makes it possible to improve the printing quality and, in particular, also avoid disruptive influences on the printed result, caused by changes in external conditions or process parameters. The printing process can thus be performed with greater process stability, e.g. also in the event of fluctuating external conditions, such as temperature fluctuations, and yields a constantly optimum printing result over long periods of time, with exact transitions between printing and non-printing areas. This is further promoted by the fact that rollers or rubber blankets according to the invention display virtually no tendency towards superficial accumulation of hydrophilizing substances from detergents, of pigments or calcium complexes from paper coatings or ink, or the like. These advantages particularly also exist compared to rollers with only fluorinated polyolefins incorporated in the elastomer covering, and the base elastomer of the covering forming part of the roller surface. Rollers of this kind would not solve the problems on which the invention is based.

Furthermore, rollers according to the invention demonstrate outstanding back-transfer properties, substantially exceeding those of rollers in which, for example, fluorinated polyolefins are incorporated in an elastomeric covering and large proportions of the roller surface are thus provided by the base elastomer. In this context, the surface coating according to the invention ensures that a damping roller transfers virtually no printing agent, e.g. ink, back into the damping unit and, on the other hand, a coated ink roller transfers virtually no water back into the inking unit, this resulting in overemulsification being avoided in both cases. Furthermore, in the case of ink rollers, the local ink reservoir in an inking unit is reduced, the ink turnover thus being accelerated. Furthermore, a rubber blanket according to the invention transfers no water back from the image-producing printing plate, this leading to lower water settings in the wet offset process and avoiding overemulsification, and, on the other hand, transfers no ink from the preceding print unit back from the freshly printed print carrier, this permitting far more accurate color control. Surprisingly, the surface coating according to the invention fulfils the specified requirements equally well, depending on the application.

Furthermore, the rubber blanket according to the invention displays markedly reduced paper web deformation in the curling test (described, for example, as the curling and bulging test in DIN 6723 and DIN 6724). Thus, conventional rubber blankets generally display a bulge of 35 mm, or of 15 mm at best, whereas rubber blankets according to the invention can display a bulge of ≦10 mm, or easily also ≦8 or ≦5 mm (in each case for 50 sheets, solid density approx. 1.50 DV cyan). As a result, far more accurate color control is possible, and film doubling is reliably avoided.

Furthermore, compared to conventional rubber blankets, the rubber blanket according to the invention achieves far better printing quality in multicolor printing in terms of ink feed and color control of the printing result. This is achieved by particularly high dot accuracy in printing agent transfer, this leading to high color accuracy of the printing result. This is of decisive importance in multicolor printing, in particular, since the dot accuracy of the screen-like transfer of the individual ink dots of different color is of eminent importance for the printing result. This is attributed to the special interaction of the print carrier with the rubber blanket, which surprisingly also yields particularly quiet running of the printing agent carrier, which additionally permits higher printing speeds. Without being bound by theory, it is assumed that this is attributable to the special physicochemical properties of the rubber blanket coating and its surface, such as the particularly low roughness, and the elastic properties of the cover layer, in which context the low thickness also results in the coating having virtually no influence on the deformation behavior of the covering, this being of essential importance.

Furthermore, the coating made of a fluoroelastomer, particularly fluorinated rubber, provides a roller which displays a particularly long service life and, over its service life, virtually no changes in its properties, such as surface condition, wetting and swelling behavior vis-à-vis printing agent and/or damping solution, transfer of the printing agent and/or damping solution to downstream equipment of the printing press, such as a downstream roller or a rubber blanket, cleaning properties, etc. This is probably attributable to the fact that, under the process conditions, fluoroelastomers, particularly fluorinated rubbers, act as a diffusion barrier vis-à-vis a host of substances, such as solvents in the printing agents, plasticizers in the elastomeric coverings and the like. This simultaneously effectively prevents diffusion of solvent constituents from the printing agent into the roller, and also diffusion of plasticizers out of the roller over long periods of time, meaning that highly constant process control is possible. It goes without saying that the fluoroelastomer coating preferably contains no plasticizers.

Furthermore, rollers and rubber blankets according to the invention are cleaned particularly easily, especially also of fast inks and inks containing metal pigments, such as used in offset printing, as a result of which downtimes are substantially reduced. In particular, this also results in very substantial savings on mineral oil-based cleaners, and the use of water-based cleaners becomes possible at all.

The surface coating is preferably homogeneous over its depth profile, i.e. it displays no gradients as regards its physical properties, such as hardness, degree of crosslinking and/or its composition. The same can also apply to the elastomeric covering.

The fluoroelastomer preferably completely covers the elastomeric covering, at least in the working area of the roller or the rubber blanket, preferably over the entire surface of the roller or the rubber blanket. The outer surface of the fluoroelastomer coating is preferably textureless and as smooth and level as possible, e.g. with an average roughness Ra pursuant to EN ISO 4287 or DIN 4768 of approx. ≦1 μm, ≦0.4-0.5 μm, ≦0.25 μm or ≦0.1 μm.

The fluoroelastomer coating, and preferably also the elastomeric covering, is preferably virtually or completely free of pores. The fluoroelastomer coating preferably constitutes the outermost surface of the roller or the rubber blanket, coming into contact with the printing agent, although a further coating layer can, where appropriate, also be provided in the manner of a cover layer. Where appropriate, intermediate layers can be provided between the fluoroelastomer coating and the elastomeric covering, although it is preferable for no further intermediate layer to be provided, apart from an adhesive or primer layer.

If the roller coating containing the fluoroelastomer contains further particulate constituents, such as fillers and/or non-elastomeric polymers, the fluoroelastomer preferably provides a continuous matrix accommodating the other constituents, such that a continuous, three-dimensional network structure is formed from the fluoroelastomer, and the coating as a whole displays elastomeric properties over its radial and both its lateral or circumferential directions of extension. The coating is preferably free of particulate, including fibrous, fillers.

It goes without saying that the elastomeric covering is applied to a stable roller core consisting, for example, of a metal or another dimensionally stable material. The elastomeric covering is preferably mounted directly on the roller core, apart from a layer of adhesive or primer, where appropriate, although intermediate layers can also be provided, where appropriate. In the case of a rubber blanket, the blanket is mostly only coated with an elastomeric covering on one side, in which context several fabric plies can also be provided.

The fluoroelastomer, particularly the elastomeric fluorinated rubber, is preferably present in the surface coating with a content of ≧40-50% by weight, preferably ≧75 or ≧85 or ≧90 or 95% by weight, referred to 100 parts by weight of the coating. The surface coating can consist entirely of the fluoroelastomer, particularly the elastomeric fluorinated rubber. The indicated percentages of fluoroelastomer or fluorinated rubber can alternatively each refer to 100 parts by weight elastomer or polymer of the coating.

The fluoropolymer or the fluorinated rubber is particularly preferably formed of a fluorinated rubber latex. Latices of this kind are advantageous because of their surface properties, in particular, especially as regards the prevention of overemulsification and the properties as a diffusion barrier vis-à-vis solvents, plasticizers and the like. Within the meaning of the invention, a latex is taken to mean a colloidal dispersion of a polymer in an aqueous medium. The latex or the polymer can be produced naturally or synthetically. The latex can be produced by emulsion polymerization of suitable monomers, or by dispersion of polymers in a dispersing agent. The dispersed particles can have a mean diameter of approx. 0.2 to approx. 1 nm or up to approx. 2 or 5-10 nm, e.g. approx. 0.5 nm, without limitation. The latex can contain additives, such as dispersing agents, etc.

It has furthermore become apparent that fluoroelastomers, particularly fluorinated rubbers and especially those based on fluorinated latices, demonstrate a particularly low storage capacity in terms of the uptake and storage of the printing agent or components thereof and/or of damping solution components, such as alcohols and the like.

The fluoroelastomer, particularly the fluorinated rubber, preferably displays a high fluorine content, in which context other halogens can also be present, particularly chlorine. The atomic ratio of halogen to hydrogen (particularly fluorine to hydrogen) can be ≧3:1, particularly ≧4.5 or 5:1, preferably ≧6 or ≧7:1, e.g. ≧8:1 or 9:1, and also ≧15:1 where appropriate. The fluoroelastomer (fluorinated rubber) is preferably not perhalogenated/perfluorinated, meaning that a significant hydrogen content is present, i.e. the polymer is not perfluorinated/perhalogenated, as a result of which the hydrophobicity and oleophilicity of the roller surface can be set particularly favorably. For example, the atomic ratio of hydrogen:halogen (particularly hydrogen:fluorine in each case) can be ≧1:40 or ≧1:19, or ≧1:15 or ≧1:9.5. The overall atomic fluorine ratio relative to the total halogen content of the fluoroelastomer or fluorinated rubber, or of the surface coating containing them, is preferably ≧75:25, preferably ≧90:10 or 95:5. Particularly preferably, the entire halogen of the fluoroelastomer (rubber) or the surface coating is fluorine.

The fluorine content of the elastomeric fluoropolymer or the fluorinated latex can furthermore be approx. 64% by weight to approx. 74 or approx. 75% by weight or more, preferably greater than/equal to approx. 66 or 67% by weight and/or less than/equal to 76% by weight, e.g. approx. 66 to approx. 72% by weight, particularly preferably approx. 66 to approx. 70% by weight, particularly approx. 68% by weight (figures referred to the coating in each case). The fluorine content indicated here can, where appropriate, also refer in each case to the polymeric constituents of the surface coating or the surface coating as a whole.

The fluoroelastomer or the fluorinated rubber can contain or be an elastic terpolymer.

Particularly preferably, the fluorinated rubber contains, or consists of, a fluoroterpolymer, which thus displays three different monomers. Particularly preferably, the terpolymer is a vinylidene fluoride terpolymer, particularly tetrafluoroethylene hexafluoropropylene vinylidene fluoride terpolymer (TFE-HFP-VDF). Where appropriate, the coating can contain other fluorocopolymers (of two different monomers) or fluoroterpolymers. The percentage by weight of terpolymers in the coating is preferably greater than the content of copolymers, TFE-HFP-VDF preferably being present in higher percentages by weight than other copolymers or terpolymers or polymeric constituents, either singly or in total. The coating or the terpolymer can contain fluorinated olefin monomers and vinyl fluoride and/or vinylidene fluoride monomers, which can be present in a total proportion of 5 to 90% by weight to 100 parts by weight elastomer or terpolymer.

The fluoroelastomer surface coating preferably contains the fluoropolymer, particularly TFE-HFP-VDF, in a content of 5 to 100% by weight, e.g. 10 to 98% by weight, e.g. ≦80 or ≦75 or ≦50% by weight, referred in each case to 100 parts by weight of the coating. The fluoroelastomer, particularly TFE-HFP-VDF, is in each case preferably contained in a proportion of ≧10% by weight or ≧20 or ≧30 or ≧50 or ≧70 or ≧80% by weight. The percentages by weight can in each case alternatively refer to 100 parts by weight polymer of the coating composition.

The fluorinated rubber preferably contains vinyl fluoride and/or vinylidene fluoride monomer units. The proportion of vinyl fluoride and/or vinylidene fluoride monomers, referred to the total weight of polymer, or alternatively referred to the total weight of fluoroelastomer in the coating, can be 5 to 90% by weight, where appropriate ≦75% by weight, or ≦50 or 30% by weight. The content of vinyl fluoride and/or vinylidene fluoride in the fluorinated rubber can, in particular, be in the range from 5 to 40% by weight or 10 to 40% by weight or 10 to 30% by weight. The contents indicated can in each case refer to the content of vinyl fluoride, on the one hand, or vinylidene fluoride, on the other. Where appropriate, the contents of vinylidene fluoride and/or vinyl fluoride, or respectively of vinyl fluoride or vinylidene fluoride, can refer to the percentage by weight in the surface coating as a whole.

Alternatively or in addition to the content of vinyl fluoride and/or vinylidene fluoride in the fluorinated rubber, at least one, two or more monomers of another —C=C— unsaturated monomeric unit can be contained, where the monomer in each case contains fluorine, where appropriate alongside another halogen, particularly such as chlorine, and is particularly perfluorinated in each case. Unsaturated monomers of this kind can, for example, be one or more monomers selected from the group comprising tetrafluoroethylene, trifluoroethylene, trifluoro-chloroethylene, pentafluoropropylene, pentafluorochloropropylene, hexafluoropropylene, and vinyl fluoride. Where appropriate, one or more of the monomers can additionally or alternatively be selected from the group comprising fluoropropyl vinyl ether, fluoroethyl vinyl ether or fluoromethyl vinyl ether, in each case particularly as a perfluoro compound, where one or more fluorine atoms can, where appropriate, also be replaced by another halogen, particularly chlorine. Where appropriate, the coating can contain a hexafluoropropylene vinylidene fluoride copolymer or a tetrafluoroethylene vinylidene fluoride copolymer. One or more of the monomers from the two groups indicated above can, either singly or in total, be contained in a proportion of 5 to 80% by weight, where appropriate ≦75 or ≦50 or ≦30% by weight, referred in each case to 100 parts by weight polymer of the coating composition, preferably in a range from 5 to 20% by weight or between 10 and 20% by weight. Where appropriate, the proportions indicated above can also refer to 100 parts by weight fluoroelastomer. Where appropriate, the proportions indicated above can also refer to 100 parts by weight of the surface coating, which can also contain other components, such as fillers and the like.

The elastomeric fluoropolymer can be a block polymer or, where appropriate, a statistical polymer.

The skeleton of the elastomeric fluorinated rubber and/or of other polymeric constituents of the coating, preferably of all polymers of the surface coating according to the invention, or the coating as a whole, can in each case be free of heteroatoms, particularly free of ether, ester, amine, silane, acrylate and/or methacrylate groups, particularly also virtually or essentially free of O, N and/or Si atoms. In particular, the skeleton of the polymers can in each case be a virtually pure carbon skeleton. The fluorinated rubber and other polymeric components and, where appropriate, also auxiliaries, such as dispersing agents and adhesion promoters, etc., can be essentially or completely free of functional groups, particularly side-groups containing O, N and/or Si atoms, such as ether groups, or free of heteroatoms except halogen. This in each case preferably refers to the uncured rubber, disregarding corresponding curing agents or other auxiliaries. However, the fluorinated rubber preferably does contain halogenated, particularly perhalogenated, alkyl side-groups, where the halogen can in each case be fluorine, particularly $—CF_3$ and $—C_2F_5$ groups.

Preferably, less than 10 or 5%, preferably less than 1 or 2%, of the atoms of the fluoroelastomer or the fluorinated rubber, referred in each case to 100 carbon atoms of the elastomer, are present in unsaturated groups, the fluoroelastomer (fluorinated rubber) particularly preferably displaying virtually no unsaturated groups.

The elastomeric fluoroelastomer (fluorinated rubber) coating can, where appropriate, also contain non-fluorinated elastomers, e.g. in a proportion of ≦20% by weight, preferably ≦10% by weight, particularly preferably ≦5% by weight, referred in each case to 100 parts by weight polymer. These elastomers can be non-fluorinated rubber or other substances, such as can also be used as the base material for the elastomeric covering. Preferably, however, all elastomer is present in the form of fluoroelastomer, including copolymers or terpolymers thereof.

Furthermore, it can be preferable if the elastomeric fluorocoating contains at least one or more additional, non-elastomeric polymers, particularly non-elastomeric fluoropolymers, each of which can also contain other halogen atoms, particularly chlorine, but preferably exclusively fluorine as the halogen. The non-elastomeric polymer can be partially fluorinated or perfluorinated. The non-elastomeric polymer can, for example, be a perfluorinated polyolefin, particularly polytetrafluoroethylene (PTFE). The non-elastomeric polymers can be present in the coating composition in a proportion of ≦50 or 75% by weight, ≦20% by weight, where appropriate ≦10 or ≦5% by weight, referred to 100 parts by weight polymer of the fluoroelastomer coating, where the coating composition can also be virtually free of such non-halogenated or non-fluorinated polymers.

The non-elastomeric and/or non-fluorinated polymers can be distributed in the elastomeric coating in dispersed, particularly finely dispersed, form, the size of the areas of these polymers having, for example, a mean diameter less than/equal to approx. 0.2 nm, up to approx. 1, or up to approx. 2 or 5-10 nm, e.g. approx. 0.5 nm, without being limited to this. These areas can transition into the surrounding polymer in flowing fashion, or be virtually fused with it.

The non-elastomeric, particularly halogenated or fluorinated, polymer can be contained in the elastomeric fluorocoating in a proportion of 5 to 80% by weight or, where appropriate, also more, particularly in a proportion of ≦60% by weight, ≦40 or ≦20 or ≦10% by weight, referred in each case to 100 parts by weight polymer. Where appropriate, the coating composition can, however, also be free of non-elastomeric polymers or fluoropolymers of this kind.

The elastomeric coating of the roller or the rubber blanket can, in particular, consist of one or more elastomers selected from the following group: natural rubber (NR), ethylene rubber, ethylene-propylene rubber (EPDM, EPM), styrene-butadiene rubber (SBR), acrylonitrile-butadiene rubber (NBR, HNBR, XNBR), butyl rubber, polychloroprene rubber, polyurethane rubber (PUR), polyacrylate rubber (ACM), epichlorohydrin rubber, silicone rubber, without being limited to this. In the case of rubber blankets, the elastomeric covering mostly consists of NBR, FKM or acrylate rubber. It goes without saying that, in general, the base elastomer of the covering can be different from the fluoroelastomer coating.

Both in a roller according to the invention and in a rubber blanket, the covering made of elastomeric material can display a hardness of approx. 15 to approx. 100 Shore A, e.g. approx. 15 or 20 Shore A to approx. 60 or 85 Shore A, particularly in the range from approx. 20 to approx. 40 Shore A. In the case of a rubber blanket, the hardness of the covering bearing the coating is preferably approx. 50-60 Shore A to approx. 80-90 Shore A.

The hardness of the elastomeric surface coating can be different from, i.e. greater or less than, the hardness of the elastomeric covering bearing the coating. The degree of crosslinking of the elastomeric surface coating can be different from, i.e. greater or less than, the degree of crosslinking of the elastomeric covering bearing the coating.

The radial thickness of the covering of elastomeric material can be in the range from approx. 0.5 to approx. 50 mm or more, preferably being greater than approx. 1 mm or greater than approx. 5 mm, e.g. in the range from 5 to 15 or up to 20 mm, which can particularly apply to rollers. In the case of a rubber blanket, the thickness of the same, i.e. the thickness of the elastomeric covering including the fabric ply, can particularly lie in the range from approx. 1 to approx. 0.10 mm, particularly in the range from approx. 1 or 1.5 to approx. 5 mm, e.g. in the range from approx. 1.5 to approx. 2.2 mm.

The surface coating can contain other customary auxiliaries, particularly such as fillers, pigments and antioxidants, as well as various other additives, such as curing agents, acid scavengers, wetting agents, plasticizers and the like. The surface coating is, however, preferably free of plasticizers.

The fillers can be present in a content of ≦20% by weight, preferably ≦10% by weight or ≦5% by weight, referred to 100 parts by weight of the coating with the elastomeric fluoropolymer, the filler content preferably being ≦2% by weight. If fillers are used, they can be, for example, silicon dioxide, titanium dioxide, sulfates, such as barium or calcium sulfate, carbonates, such as barium or calcium carbonate, silicates, silica gels, aluminum dioxide, aluminosilicates, fibrous materials, such as glass fibers, carbon fibers or the like, and also carbon black, where appropriate. In particular, the fluoroelastomer or fluorinated rubber coating can be virtually free of fillers. Independently hereof, the coating can be essentially or completely free of fibers.

Furthermore, the coating of fluoroelastomer can be virtually free of particulate inclusions in the elastomer.

Amine-curing types in particular, but also peroxide or bisphenol-curing types, can be used as the fluorinated rubber, particularly as fluorinated rubber latices. Various suitable curing agents are known, e.g. aliphatic polyamines, such as triethylene tetramine, ethylenediamine, hexamethylene diamine carbamate, ethanolamine, etc., aromatic polyamines, such as phenylenediamine, or polyamide amines, polyols, including phenol derivatives like bisphenol, hydroquinone or the like, dicumyl peroxide, dibenzoyl peroxide, each including their salts. Various other curing systems for fluorinated rubber latices are known and may be usable, where appropriate. For each 100 parts by weight fluoropolymer, it is possible, for example, to use 0.5 to 5, e.g. approx. 1 to 2, parts by weight curing agent to 100 parts polymer to be cured, without being limited to this.

It goes without saying that an adhesive or primer layer can be located between the elastomeric fluorinated rubber surface coating and the elastomeric covering, for which purpose suitable primers, such as silane-containing primers, can be used.

The radial thickness of the elastomeric fluoro-coating can be in the range from 1 μm to 1 mm, for example, without being limited to this, e.g. in the range from 10 μm to 1 mm. The thickness of the surface coating is preferably in the range from 1, 5 or 10 μm to 100 μm. For example, the layer thickness is ≦10 μm or ≦20-30 μm or ≦40-50 μm.

In relation to pure water, the fluoroelastomer layer, particularly the fluorinated rubber layer, can have a wetting angle of ≧80°, preferably ≧90° or ≧100° (standard conditions, NTP). In relation to diiodomethane, the fluoroelastomer layer, particularly the fluorinated rubber layer, can have a wetting angle of ≧60°, preferably ≧70° or ≧80° (standard conditions, NTP). The wetting angles were in each case determined by the sessile drop method, using equipment from the Krüss GmbH company of Hamburg, Germany.

The elongation at break of the fluoroelastomer (fluorinated rubber) coating can be >100%, preferably >120% or >150%, possibly also >170% (determined in each case according to DIN 53504). The coating preferably has a reversible extensibility of >40-50%, preferably >70%, such that the roller or the rubber blanket can be exposed to high dynamic stresses.

The roller/rubber blanket used according to the invention can display an elastomeric covering that has, at least over part of the covering layer thickness, an essentially continuous hardness gradient, particularly a continuous hardness decrease towards the center axis/center plane of the roller/rubber blanket. A roller with a covering of this kind is described in DE 101 29 107, the content of which is herewith completely incorporated by reference. It goes without saying that the same can also apply to the covering of a rubber blanket. The hardness gradient preferably extends over a difference in the effective hardness of the roller coating of more than 5 Shore A, preferably more than 10 or 20 Shore A. The term "effective hardness" is defined in the sense of DE 101 29 107. The area of the layer displaying the hardness gradient is preferably located on the roller surface/rubber blanket surface, or in an area starting from there and extending to a depth of approx. 10 or approx. 20 μm of the covering. The layer thickness of the hardness gradient can be greater than/equal to 0.05 mm or greater than/equal to 0.1 mm and less than/equal to approx. 1 to approx. 2 mm, although it can also demonstrate a greater layer thickness. The hardness gradient can be created by a gradient in one or more of the components of the roller coating, particularly one or more components from the group comprising fillers, hardener, curing agent, activator, photoinitiator, monomers and oligomers of a polymeric material, and plasticizer. The hardness gradient is particularly preferably generated by a gradient in the degree of crosslinking of a component of the covering material, particularly of a matrix material of the same. The curing agent can be selected from the group comprising peroxide, sulfur, halide, sulfur halide or the like. In particular, the hardness gradient can be incorporated by diffusion or migration of a hardness-modifying substance, or a precursor thereof, from the surface of the roller covering/rubber blanket covering into the covering material. It goes without saying that the hardness gradient refers to the covering material of the roller/rubber blanket, disregarding the fluoroelastomer coating applied. The combination of the fluoroelastomer surface coating, which codetermines the superficially acting forces, and the described hardness gradient on the surface of the covering or in the area of the covering close to the surface, which codetermines the dynamically acting forces, results in particularly advantageous properties of the roller/rubber blanket in terms of preparation of the damping solution/printing agent in the nip, or in the gap between the rubber blanket and the plate cylinder or the print carrier, this having a particularly favorable impact on the transport and preparation of the damping solution/ink.

Surprisingly, the roller according to the invention has also proven successful as a laminating roller in a laminating system, since, when laminating plastics, particularly when laminating polyolefins, such as polyethylene, the roller does not pick up any plastic or any polyethylene, thus resulting in improved products.

The elastomeric surface layer of a roller according to the invention, or of a rubber blanket, can in each case be subjected to non-mechanical surface treatment in order to vary the surface properties, such as the wetting properties in relation to the printing agent and/or the damping-solution, or the above-mentioned wetting angles in relation to water and/or diiodomethane. The surface treatment can, in particular, consist of physical treatment to modify the electrostatic properties of the surface. Surface treatment can be performed, for example, in the form of plasma treatment, corona discharge and/or electrostatic discharge. The plasma can, in particular, be an oxidizing plasma or an atmospheric plasma.

To manufacture the roller according to the invention, a roller with an elastomeric covering can be used, on which the elastomeric covering is applied to a rigid roller core, e.g. made of metal, by means of an adhesive layer, where appropriate. The elastomeric covering can be cleaned with a solvent and provided with an adhesion promoter (primer), e.g. a silane primer, where the primer is applied in a suitable solvent by suitable methods, such as spraying, brushing, doctoring or the like. After allowing the primer to act for a sufficiently long period of time, e.g. 30 minutes, possibly at a slightly elevated temperature (e.g. 40° C. to 50° C.), the fluoroelastomer (e.g. fluorinated rubber) can be applied in the form of a water-based fluorinated rubber latex. It can be applied by spraying, brushing, dipping, doctoring or the like. The fluorinated rubber layer can be produced by applying a single layer, although multiple application may also be necessary to achieve greater layer thicknesses, where appropriate. The fluorinated rubber latex can be applied together with the hardener or curing agent after mixing with it. Where appropriate, the latex can also be diluted beforehand. Following application of the fluoroelastomer, the layer can generally be dried for a sufficiently long period of time, e.g. for one to two hours, in which context drying may not always be necessary. Drying can take place at room temperature or at a slightly elevated temperature. This can be followed by hardening of the fluoroelastomer coating under suitable conditions, particularly at an elevated temperature, for instance for a period of 1 to 10 hours at temperatures in the range from 80° C. to 150° C., e.g. 100° C. to 120° C., where the conditions can be dependent on the elastomer or rubber used. Drying and/or hardening thus generally takes place at a temperature in excess of the film-forming temperature of the latex. The roller can generally be put into service in a form fit for use without mechanical post-treatment of the surface coating, such as grinding, polishing, etc.

The same applies to the manufacture of a rubber blanket coated according to the invention, in which context a rubber blanket is coated under corresponding, suitable conditions with an elastomeric coating that may display a supporting layer in the form of a fabric, a net, a non-woven material or the like.

In printing presses, or in print units of printing presses designed to each apply a different color to the respective print carrier, e.g. a paper web, rollers according to the invention can be used as damping solution transfer rollers and/or as printing agent transfer rollers. The rollers according to the invention can in each case be located in the damping unit and/or the inking unit of the printing press, which supplies damping solution or printing agent in essentially separate manner to the impression cylinder and the printing plate with an image, although the rollers can also be part of a combined damping/inking unit, which supplies damping solution and printing agent to the impression cylinder in the form of an emulsion. The rollers according to the invention can in each case be designed as dip rollers, metering rollers and/or ductor rollers, preferably being located downstream of the dip roller in each case. This applies both to the damping unit and the inking unit in each case. One, several or all rollers of the damping and/or inking unit can be designed according to the invention in each case. In an inking unit, the rollers according to the invention can particularly act against a distributor roller, which displays a non-elastomeric coating, or a metallic or ceramic surface, which can be coated to modify the surface properties, where appropriate, where the hardness of the distributor roller is substantially greater than that of the roller with elastomeric covering, and the distributor roller performs an oscillating movement in its longitudinal direction. In particular, the rollers according to the invention can be damping dip rollers and damping metering rollers in continuous-feed damping units.

Furthermore, the roller according to the invention can be a laminating roller of a plastic laminating system on which a substrate is laminated with a plastic, particularly a polyolefin, such as polyethylene.

Furthermore, the damping solution and/or printing agent transfer devices according to the invention can be designed in the form of a rubber blanket, which is usually mounted on a cylinder in the printing press, from where it applies the printing agent to the print carrier in order to print it. In this context, the rubber blanket is usually provided with rails at the edges or fixed to the surface of a plate, e.g. bonded, to be able to be fastened to the blanket cylinder.

The damping solution and/or printing agent transfer devices according to the invention can, in particular, be those of offset printing presses, being provided as a roller and/or a rubber blanket in the respective print unit of the printing press, which is each cases prints a given printing agent. The printing press can encompass a blanket washer as usual.

The roller immediately following the roller according to the invention in the direction of transport of the damping solution/printing agent in the printing press, and acting against it to form a nip, preferably displays a higher surface tension than the first roller.

Conventional rollers customarily have to be elaborately reconditioned following wear-induced abrasion, in that the entire elastomeric roller covering is replaced, in which context restoration of generic rubber blankets is virtually impossible.

In contrast, rollers according to the invention are particularly easy to restore following wear-induced abrasion. The roller to be restored usually still displays a surface coating containing, or consisting of, fluoroelastomer (fluorinated rubber) of significant thickness, e.g. $\geqq 5$ or $\geqq 10$ μm. On this roller to be restored, the surface can initially be ground down slightly to produce a uniform and smooth surface, in which context it is preferable to remove the entire fluoroelastomer coating and a small thickness of the elastomeric covering beneath it, e.g. a thickness of approx. 10 μm, although the fluoroelastomer coating can also be only partially removed, where appropriate. The fluoroelastomer or the fluorinated rubber can subsequently be applied up to the required thickness again in the form of a latex by means of suitable coating methods, e.g. by dipping, spraying, brushing, doctoring or the like. After drying and hardening of the fluoroelastomer under suitable conditions, which can correspond to those during production of the new roller, a fully functional roller can be produced again without completely removing the elastomeric covering. Also, subsequent surface treatment, particularly such as regrinding or polishing, can usually be dispensed with, although this can be performed, where appropriate. This greatly simplifies restoration of the roller, quite apart from the fact that, owing to the fluoroelastomer coating, the rollers already demonstrate a particularly long service life of approx. 1 to 2 years, compared to a service life of approximately six months with conventional rollers.

BRIEF DESCRIPTION OF THE DRAWINGS

An example of the invention is described below and explained on the basis of the Figures. The Figures show the following.

DETAILED DESCRIPTION

Figure 1:
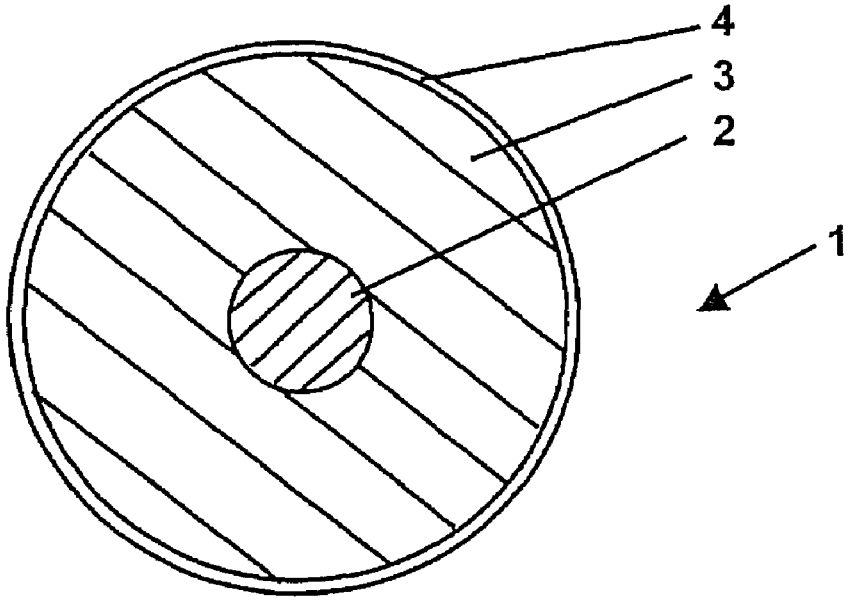
FIG. 1 A cross-sectional representation of a roller according to the invention, FIG. 2 A cross-sectional representation of a rubber blanket according to the invention, and FIG. 3 A schematic view of a printing press with roller and rubber blanket according to the invention.

FIG. 1 shows a roller according to the invention, such as can be used in an offset printing press as a damping solution transfer roller, particularly a damper roller, or as a printing agent transfer roller, particularly a plate inking roller. Roller 1 displays a core 2, made of dimensionally stable material, such as a rigid plastic or metal, e.g. steel or aluminum. A roller covering 3, made of an elastomeric material, is applied to cote 2, an adhesive layer (not shown) being provided between the core and the covering. The roller covering can consist of a suitable elastomeric material, such as acrylonitrile-butadiene rubber (NBR), butyl rubber or the like. The covering has a radial thickness of approx. 10 mm and a hardness of approx. 30 Shore A.

Applied to roller covering 3 by means of an adhesion-promoting layer (not shown) is a coating of an elastomeric fluorinated rubber in the form of a latex, which displays TFE-HFP-VDF terpolymer in combination with PTFE in a weight ratio of approx. 60:40. The fluorinated rubber coating is free of fillers and plasticizers, and has a thickness of approx. 25 μm. The outer surface of coating 4, made of elastomeric fluorinated rubber, directly forms the outermost surface of the roller, which comes into contact with the damping solution or the printing agent. The surface of the elastomeric fluoro-coating is treated with an atmospheric plasma.

Figure 2:
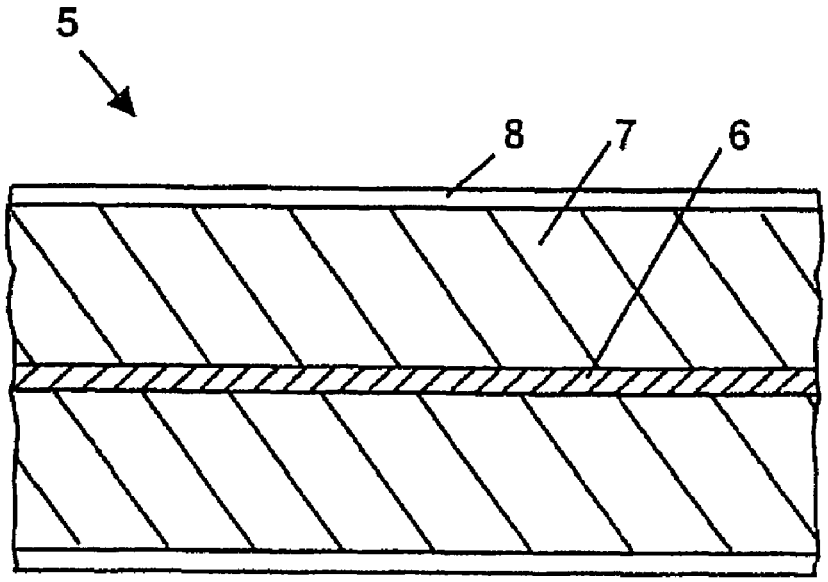

FIG. 2 shows a rubber blanket 5 according to the invention, which displays a center fabric ply 6, which is coated to a suitable thickness, e.g. approx. 2 mm, with a covering 7 made of elastomeric material, such as NBR, FKM or acrylic rubber. The covering displays a hardness of approx. 60 Shore A. Elastomeric covering 7 is provided on one side, or also on both sides where appropriate, with a surface coating 8 made of elastomeric fluorinated rubber, which can display a thickness of approx. 30 μm and consists of a TFE-HFP-VDF copolymer in combination with PTFE in a ratio of approx. 70:30 parts by weight. The elastomeric fluorinated rubber layer is again free of fillers and plasticizers. Here, too, an adhesion promoting layer (not shown) is preferably provided between fabric ply 6 and elastomeric covering 7, or between the outer surface of elastomeric covering 7 and surface coating 8. In all other respects, reference is made to the practical example according to FIG. 1 as regards the compositions and properties of the elastomeric covering and the surface layer. For mounting on a cylinder, the opposite, lateral edges can be provided with suitable fastening rails, or the rubber blanket can be bonded to a plate.

In both practical examples, the fluorine content of the elastomeric fluorinated rubber coatings is approx. 68% by weight, or also up to approx. 75% by weight, referred to the coating, the wetting angle in relation to water being approx. 95° in each case, the wetting angle in relation to diiodomethane being approx. 80° in each case.

In the event of wear-induced abrasion, the roller or the rubber blanket according to the invention can be restored particularly easily, in that the surface of a roller or a rubber blanket with a remaining coating of elastomeric fluorinated rubber having a thickness of 5 to 10 μm, for example, is cleaned and new fluorinated rubber subsequently applied, the composition of which preferably corresponds to that of the existing layer, although this is not always necessarily the case. The fluorinated rubber coating containing a hardener or a curing agent, which is applied by a spraying method, for example, can subsequently be dried for a sufficiently long period of time, such as one to two hours, and thereafter hardened at an elevated temperature, e.g. for three to four hours at 100° C. to 120° C. Repeated application with subsequent hardening is necessary if relatively thick fluoroelastomer layers are required. The roller can then be used without any further surface treatment.

The roller and rubber blanket according to FIGS. 1 and 2 display a hardness gradient, where a continuous hardness gradient with a hardness decreasing towards the inside follows on from the surface of elastomeric covering 7, i.e. adjacent to surface coating 8. The continuous hardness gradient extends over a layer thickness of approx. 0.5 to approx. 1 mm, the hardness dropping from approx. 60 Shore A in the layer of the covering close to the surface to approx. 30 Shore A in the inner layer. The hardness gradient was obtained by producing a gradient in the degree of crosslinking of the elastomeric covering material by diffusing a curing agent into the covering. The fluoroelastomer coating was applied subsequently.

Figure 3:
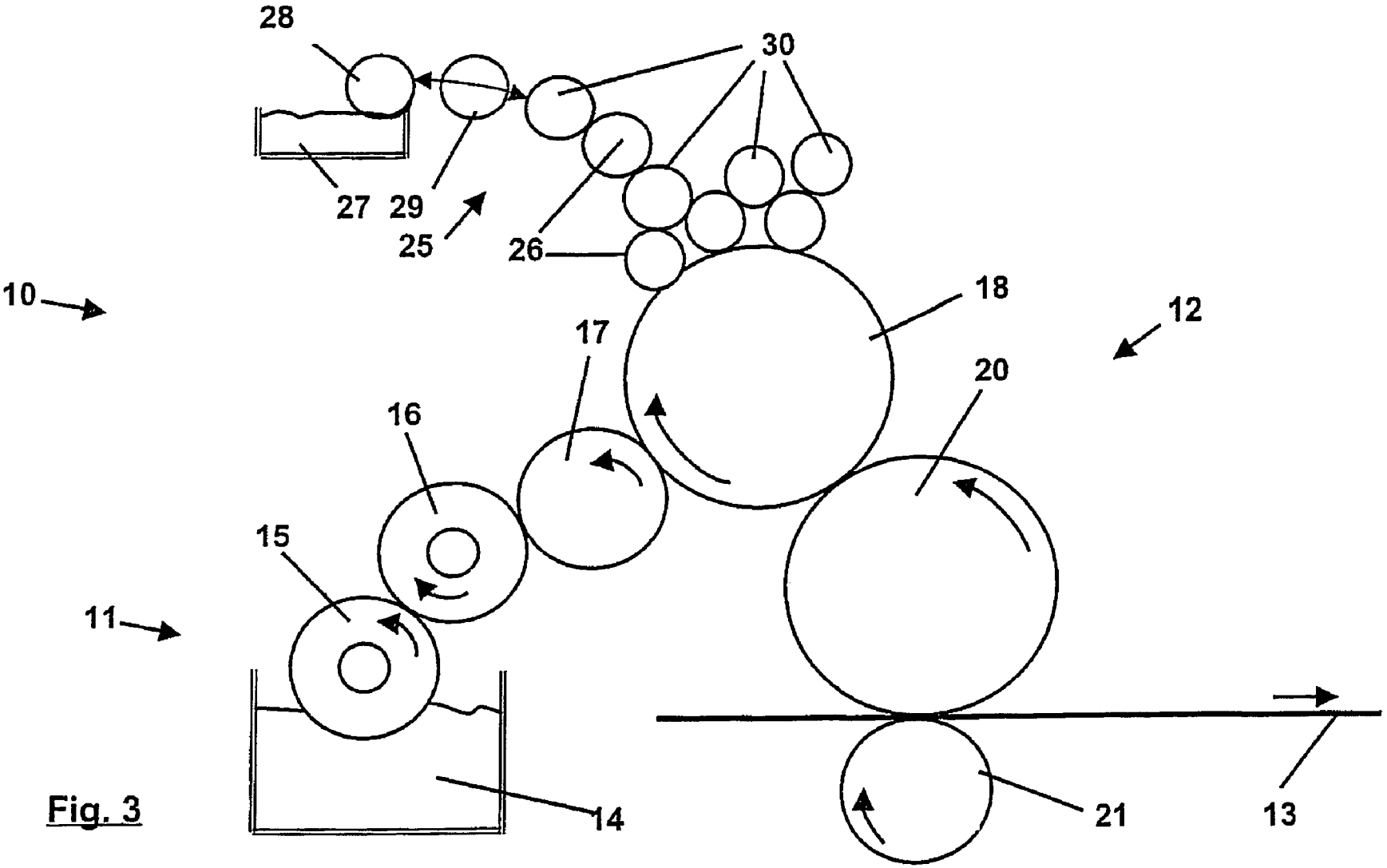

FIG. 3 shows an offset printing press 10 with a damping unit 11, particularly a continuous-feed damping unit, and a print unit 12 for printing a print carrier 13, such as a paper web. Damping unit 11 displays a damping solution reservoir 14, from which a damping solution, such as water mixed with auxiliaries, is delivered by means of a dip roller 15, the quantity of damping solution delivered being metered by a metering roller 16, acting against the dip roller with a small nip. The damping film transferred from the dip roller to the metering roller is subsequently transferred to at least one damper roller 17 and then from damping unit 11 to plate cylinder 18 of print unit 12. It is particularly advantageous to design the damping dip roller and/or the damping metering roller in accordance with the invention, since the surfaces of these rollers are then not impaired by the highly disruptive runback of printing agent, and cording (formation of strip-shaped inhomogeneities in the damping film at medium roller speeds) and streaking in the outlet of the respective nip are avoided. Owing to the roller coating according to the invention, the entire water film passing through the nip is transferred to the downstream roller, and a back-transferred or back-running damping film, such as is to be encountered on conventional rollers, is reliably avoided under a wide range of ambient and process conditions.

It goes without saying that damping solution metering roller 16 can in each case also contact only dip roller 15, and the damping solution application or transfer roller can directly contact dip roller 15. A plane printing plate can also be provided in place of plate cylinder 18.

Furthermore, roller 26 of inking unit 25 applies a printing ink, or a printing agent in general, to plate cylinder 18. In this context, the printing ink is delivered from ink reservoir 27 by means of ink duct roller 28 and transferred to distributor roller 30 by means of elastomer-coated ductor roller 29, where ductor roller 29 is moved back and forth in oscillating fashion between ink duct roller 28 and distributor roller 30. In this context, distributor roller 30 displays a metallic, ceramic or plastic surface. A homogeneous ink film of the required thickness is formed between the downstream ink rollers 26 and distributor rollers 30, then being transferred to plate cylinder 18. It goes without saying that inking unit 25 can alternatively also be designed as a continuous-feed inking system, in which the ink duct roller is doctored and has no direct contact with a non-elastomer-coated film roller running at machine speed.

Plate cylinder 18 displays hydrophilic areas that can be wetted by the damping solution, and hydrophobic areas that can be wetted by the printing agent, such that the arrangement of the hydrophobic areas creates an image. The image is subsequently transferred from plate cylinder 18 to blanket cylinder 20, on which a rubber blanket is mounted, and from there to print carrier 13. In this context, print carrier 13 is passed between blanket cylinder 20 and impression cylinder 21, which lie against material 13 on both sides. The arrangement described corresponds to that of an offset printing process, but it goes without saying that the invention is not limited to this process. It goes without saying that, where appropriate, the inking unit and damping unit can be designed in combination, such that an ink/damping solution emulsion is fed to plate cylinder 18 in accordance with the intended use.

One, several or all of rollers 15, 16, 17, 26, 29 and/or the rubber blanket mounted on blanket cylinder 20 can be designed according to the invention, e.g. according to the practical examples in FIGS. 1 and 2.

LIST OF REFERENCE NUMBERS

1 Roller
2 Core
3 Elastomeric covering
4 Surface coating
5 Rubber blanket
6 Fabric ply
7 Elastomeric covering
8 Surface coating
10 Printing press
11 Damping unit
12 Print unit
13 Print carrier
14 Damping solution reservoir
15 Dip roller
16 Metering roller
17 Damping solution application roller
18 Plate cylinder
20 Blanket cylinder
21 Impression cylinder
25 Inking unit
26 Ink roller
27 Ink reservoir
28 Ink duct roller
29 Ductor roller
30 Distributor roller

What is claimed is:

1. Roller or rubber blanket for a printing press, particularly an offset printing press, or roller as a laminating roller in a laminating system, where the roller or the rubber blanket comprises a covering made of an elastomeric material with an outer surface for transferring damping solution and/or printing agent in the printing press, in order to indirectly or directly transfer a damping solution and/or a printing agent to a print carrier, where the outer surface transferring the damping solution and/or the printing agent is provided by an elastomeric surface coating of the covering, wherein the surface coating contains a fluoroelastomer, and the surface coating displays a layer thickness less than/equal to 100 μm and a roughness Ra less than/equal to 1 μm, wherein the surface coating displays a wetting angle in relation to water of ≧80° and/or a wetting angle in relation to diiodomethane of ≧60°.

2. Roller or rubber blanket according to claim 1, characterized in that the surface of the surface coating has a roughness Ra less than/equal to 0.4 μm.

3. Roller or rubber blanket according to claim 1, characterized in that the fluoroelastomer is formed by a fluorinated rubber latex.

4. Roller or rubber blanket according to claim 1, characterized in that the fluorine content of the surface coating is in the range from approx. 64% by weight to approx. 75.5% by weight, referred to the polymeric coating components or to the surface coating as a whole.

5. Roller or rubber blanket according to claim 1 characterized in that the surface coating is not perfluorinated, and in that the atomic ratio of fluorine:hydrogen in the surface coating is greater than/equal to 5:1.

6. Roller or rubber blanket according to claim 1, characterized in that the fluoroelastomer contains vinyl fluoride and/or vinylidene fluoride monomer units.

7. Roller or rubber blanket according to claim 1 characterized in that the fluoroelastomer is or encompasses a terpolymer.

8. Roller or rubber blanket according to claim 1 characterized in that the fluoroelastomer comprises a tetrafluoroethylene-hexafluoropropylene-vinylidene fluoride terpolymer.

9. Roller or rubber blanket according to claim 1 characterized in that the fluoroelastomer is contained in the coating, particularly as a terpolymer, in a proportion of 5 to 98% by weight to 100 parts by weight of the coating.

10. Roller or rubber blanket according to claim 1 characterized in that the surface coating containing the fluoroelastomer additionally contains a non-elastomeric polymer, including a fluoropolymer.

11. Roller or rubber blanket according to claim 10 characterized in that the non-elastomeric polymer, including a non-elastomeric fluoropolymer, is contained in the surface coating in a proportion of 5 to 75% by weight to 100 parts by weight elastomer.

12. Roller or rubber blanket according to claim 1 characterized in that the elastomeric fluoropolymer is a block polymer.

13. Roller or rubber blanket according to claim 1 characterized in that the surface coating containing the fluoroelastomer displays a thickness of up to 50 μm.

14. Roller or rubber blanket according to claim 1, characterized in that the surface coating displays an elongation at break of >100%, or reversible extensibility of >50%, or both.

15. Printing press, particularly an offset printing press, with a roller and/or a rubber blanket according to claim 1.

16. Roller or rubber blanket for a printing press, particularly an offset printing press, or roller as a laminating roller in a laminating system, where the roller or the rubber blanket comprises a covering made of an elastomeric material with an outer surface for transferring damping solution and/or printing agent in the printing press, in order to indirectly or directly transfer a damping solution and/or a printing agent to a print carrier, where the covering is applied to a stable roller core or a blanket, wherein an adhesive or primer layer is located between the surface coating and the elastomeric covering, where the outer surface transferring the damping solution and/or the printing agent is provided by an elastomeric surface coating of the covering, the surface coating contains a fluoroelastomer, wherein the surface coating displays a layer thickness less than/equal to 100 μm and a roughness Ra less than/equal to 1 μm and wherein the elastomeric material of the covering has a hardness of 15 to 100 Shore A.

17. Roller or rubber blanket for a printing press, particularly an offset printing press, or roller as a laminating roller in a laminating system, where the roller or the rubber blanket comprises a covering made of an elastomeric material with an outer surface for transferring damping solution and/or printing agent in the printing press, in order to indirectly or directly transfer a damping solution and/or a printing agent to a print carrier, where the covering is applied to a stable roller core or a blanket, wherein an adhesive or primer layer is located between the surface coating and the elastomeric covering, wherein in a roller the radial thickness of the covering is from 1 to 50 mm and in a rubber blanket the thickness of the covering is from 1.5 to 5 mm, where the outer surface transferring the damping solution and/or the printing agent is provided by an elastomeric surface coating of the covering, the surface coating contains a fluoroelastomer, wherein the surface coating displays a layer thickness less than/equal to 100 μm and a roughness Ra less than/equal to 1 μm, wherein the elastomeric material of the covering has a hardness of 10 to 100 Shore A and wherein the filler content of the surface coating is less/equal to 10% by weight.

18. Roller or rubber blanket for a printing press, particularly an offset printing press, or roller as a laminating roller in a laminating system, where the roller or the rubber blanket comprises a covering made of an elastomeric material with an outer surface for transferring damping solution and/or printing agent in the printing press, in order to indirectly or directly transfer a damping solution and/or a printing agent to a print carrier, where the outer surface transferring the damping solution and/or the printing agent is provided by an elastomeric surface coating of the covering, characterized in that the surface coating contains a fluoroelastomer, and the surface coating displays a layer thickness less than/equal to 100 μm and a roughness Ra less than/equal to 1 μm, and wherein the fluoroelastomer is formed by a fluorinated rubber latex.

19. Rubber blanket for a printing press, particularly an offset printing press, where the rubber blanket comprises a covering made of an elastomeric material with an outer surface for transferring damping solution and/or printing agent in the printing press, in order to directly transfer a damping solution and/or a printing agent to a print carrier, where the covering is applied to a blanket, where the outer surface transferring the damping solution and/or the printing agent is provided by an elastomeric surface coating of the covering, wherein the elastomeric material of the covering has a hardness of 10 to 100 Shore A, and wherein the surface coating contains a fluoroelastomer, wherein the surface coating displays a layer thickness less than/equal to 100 μm and a roughness Ra less than/equal to 1 μm.

* * * * *

UNITED STATES PATENT AND TRADEMARK OFFICE

CERTIFICATE OF CORRECTION

PATENT NO. : 7,717,037 B2
APPLICATION NO. : 11/272474
DATED : May 18, 2010
INVENTOR(S) : Ruediger Czeranka et al.

It is certified that error appears in the above-identified patent and that said Letters Patent is hereby corrected as shown below:

In column 1, line 7, delete, "DL" and insert -- DE --, therefor.

In column 17, line 4, in claim 17, delete "less/equal" and insert -- less than/equal --, therefor.

Signed and Sealed this

Seventeenth Day of August, 2010

David J. Kappos

David J. Kappos
*Director of the United States Patent and Trademark Office*